US010698348B2

(12) United States Patent
Iguchi

(10) Patent No.: US 10,698,348 B2
(45) **Date of Patent: *Jun. 30, 2020**

(54) SELECTIVE ENERGIZATION OF HEATER ELEMENTS IN IMAGE FORMING

(71) Applicant: TOSHIBA TEC KABUSHIKI KAISHA, Tokyo (JP)

(72) Inventor: Ken Iguchi, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/547,128

(22) Filed: Aug. 21, 2019

(65) Prior Publication Data

US 2020/0142336 A1 May 7, 2020

Related U.S. Application Data

(63) Continuation of application No. 16/178,868, filed on Nov. 2, 2018, now Pat. No. 10,429,779.

(51) Int. Cl.

| | |
|---|---|
| ***G03G 15/20*** | (2006.01) |
| ***G03G 21/20*** | (2006.01) |
| ***G03G 15/00*** | (2006.01) |

(52) U.S. Cl.

CPC ..... *G03G 15/2039* (2013.01); *G03G 15/5029* (2013.01); *G03G 21/203* (2013.01); *G03G 2215/00776* (2013.01)

(58) Field of Classification Search

CPC ..... G03G 15/2039; G03G 21/203; G03G 15/5029; G03G 2215/00776

See application file for complete search history.

(56) References Cited

U.S. PATENT DOCUMENTS

| | | | | |
|---|---|---|---|---|
| 9,389,553 | B2 | 7/2016 | Yamamoto et al. | |
| 10,429,779 | B1 * | 10/2019 | Iguchi | G03G 15/2039 |
| 2007/0217836 | A1 | 9/2007 | Sone et al. | |
| 2012/0163841 | A1 | 6/2012 | Nakano | |
| 2014/0219672 | A1 | 8/2014 | Samei et al. | |
| 2015/0286174 | A1 | 10/2015 | Yamamoto et al. | |

* cited by examiner

*Primary Examiner* — Susan S Lee
(74) *Attorney, Agent, or Firm* — Kim & Stewart LLP

(57) ABSTRACT

An image forming apparatus includes a heater and a controller. The heater includes a plurality of heater elements arranged in a main scanning direction to fix an image on a sheet passing a nip. The controller is configured to determine image-forming regions and non-image-forming regions among sheet regions of the sheet divided in the main scanning direction and a sub-scanning direction based on image data of the image. The controller is further configured to determine, as heating regions, the image-forming regions and a first part of the non-image-forming regions satisfying a predetermined condition, and determine, as non-heating regions, a second part of the non-image-forming regions not satisfying the predetermined condition. The controller is configured to energize one or more of the heater elements corresponding to the heating regions, selectively at timing when the heating regions pass the nip.

17 Claims, 10 Drawing Sheets

SELECTIVE ENERGIZATION OF HEATER ELEMENTS IN IMAGE FORMING

CROSS-REFERENCE TO RELATED APPLICATION

This application is a continuation of U.S. patent application Ser. No. 16/178,868, filed on Nov. 2, 2018, the entire contents of each of which are incorporated herein by reference.

FIELD

Embodiments described herein relate generally to an image forming apparatus and an image forming method.

BACKGROUND

In a multi-function peripheral (MFP) of an image forming apparatus, toner is fixed on a sheet when printing is performed. Conventionally, a fixer including a single heater element is used, but there is also a fixer including a plurality of heater elements. Since an MFP that includes a plurality of heater elements energizes only the heater elements corresponding to a printing region, power consumption may be reduced compared to an MFP with a fixer including a single heater element.

However, when only heater elements corresponding to a printing region are energized, wrinkles are likely to be formed, potentially because amounts of water evaporation from a sheet may be different between a heated region and a non-heated region.

DETAILED DESCRIPTION

Embodiments provide an image forming apparatus and an image forming method for reducing wrinkles caused by heating of the sheet.

In general, according to an embodiment, an image forming apparatus includes a heater and a controller. The heater includes a plurality of heater elements arranged in a main scanning direction to fix an image on a sheet passing a nip. The controller is configured to determine image-forming regions and non-image-forming regions among sheet regions of the sheet divided in the main scanning direction and a sub-scanning direction based on image data of the image. The controller is further configured to determine, as heating regions, the image-forming regions and a first part of the non-image-forming regions satisfying a predetermined condition, and determine, as non-heating regions, a second part of the non-image-forming regions not satisfying the predetermined condition. The controller is configured to energize one or more of the heater elements corresponding to the heating regions, selectively at timing when the heating regions pass the nip.

Hereinafter, an image forming apparatus and an image forming method according to an embodiment will be described with reference to the drawings.

Figure 1:
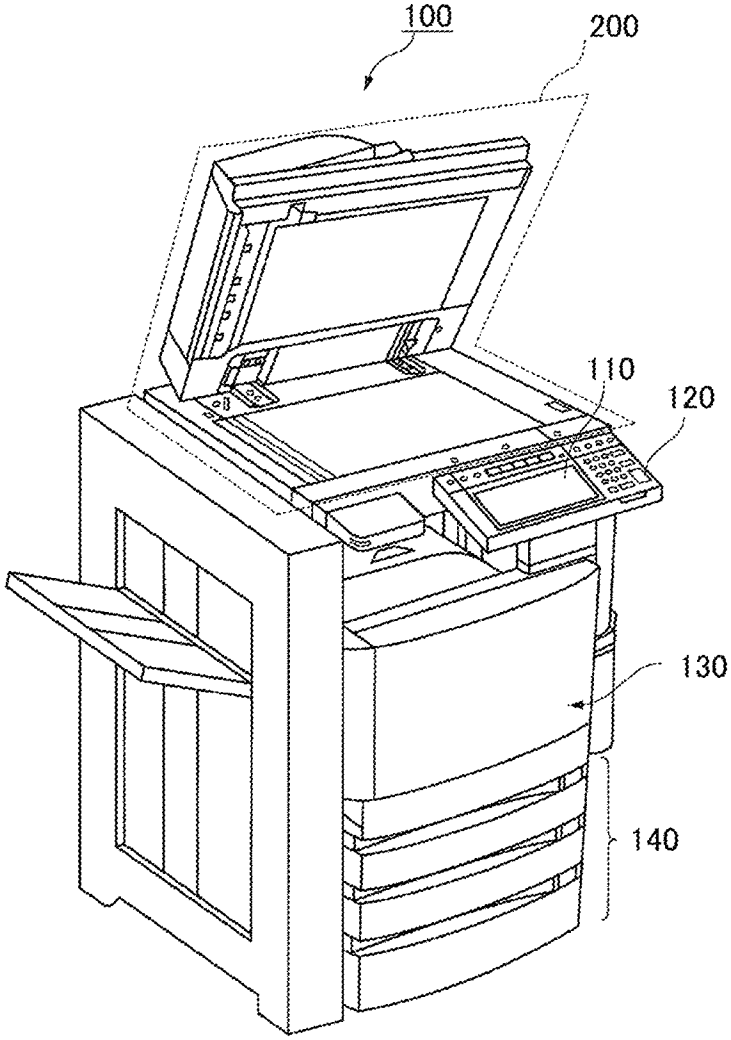
FIG. 1 is a diagram illustrating an entire configuration example of an image forming apparatus according to an embodiment.

FIG. 1 is a diagram illustrating an entire configuration example of an image forming apparatus 100 according to an embodiment. The image forming apparatus 100 is, for example, a multi-function peripheral (MFP). The image forming apparatus 100 includes a display 110, a control panel 120, a printer 130, a sheet accommodation unit 140, and an image reading unit 200. The printer 130 of the image forming apparatus 100 is an electrophotographic apparatus that fixes a toner image to form an image.

The image forming apparatus 100 forms an image on a sheet using a developer such as toner. The sheet is, for example, a paper or a label paper. The sheet may be any object as long as the image forming apparatus 100 can form an image on a surface of the sheet.

The display 110 is an image display device such as a liquid crystal display (LCD) or an electro-luminescence (EL) display. The display 110 displays various kinds of information regarding the image forming apparatus 100.

The control panel 120 includes a plurality of buttons. The control panel 120 receives an operation by a user. The control panel 120 outputs a signal in accordance with an operation performed by the user with respect to the control panel 120 of the image forming apparatus 100. The display 110 and the control panel 120 may be configured as an integrated touch panel.

The printer 130 forms an image on a sheet based on image information generated by the image reading unit 200 or image information received via a communication path. The printer 130 forms an image through, for example, the following process. An image forming unit of the printer 130 forms an electrostatic latent image on a photoconductive drum based on the image information. The image forming unit of the printer 130 forms a visible image by attaching a developer on the electrostatic latent image. As a specific example of the developer, there is toner. A transfer unit of the printer 130 transfers the visible image to the sheet. A fixer 50 of the printer 130 fixes the visible image on the sheet by heating and pressurizing the sheet. The sheet on which the image is formed may be a sheet accommodated in the sheet accommodation unit 140 or may be a sheet manually loaded. The fixer 50 included in the printer 130 will be described giving a specific example with reference to FIG. 2.

Figure 2:
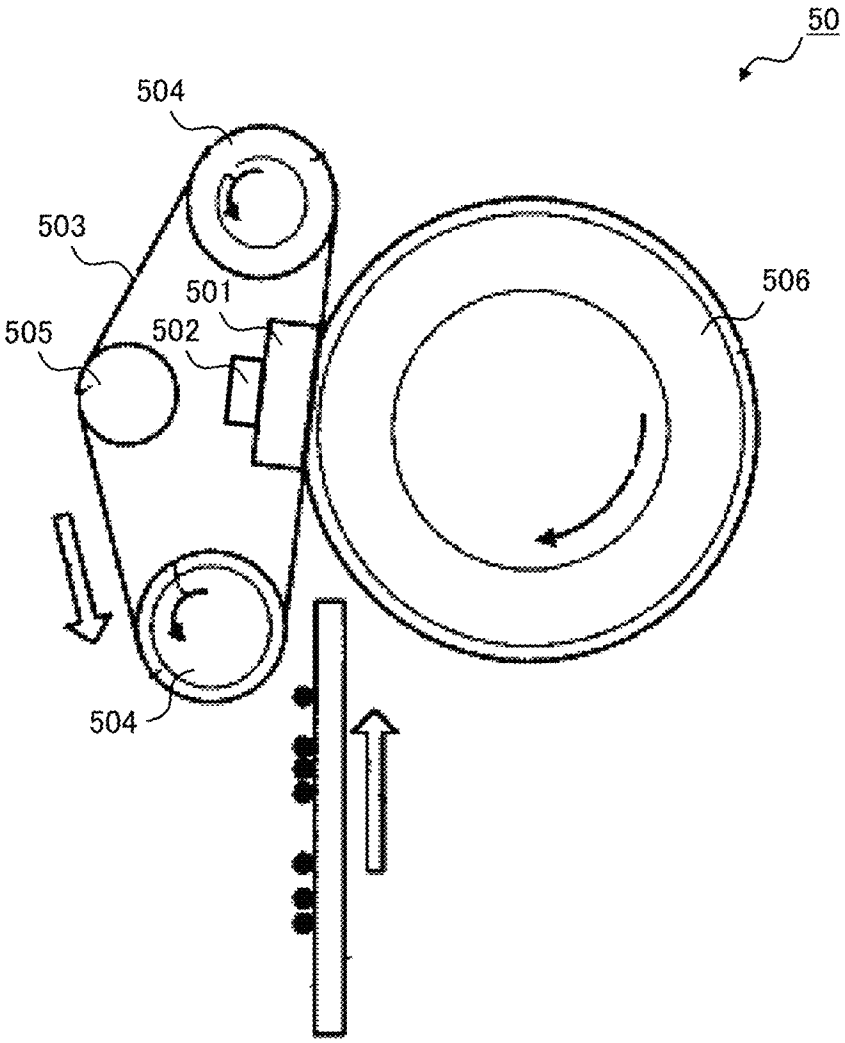
FIG. 2 is a schematic diagram illustrating a configuration example of a fixer included in a printer.

FIG. 2 is a schematic diagram illustrating a configuration example of the fixer 50. Here, the fixer 50 includes a flat-shaped heating member 501, a thermistor 502 that measures temperature of the heating member 501, an endless belt 503 that is suspended on a plurality of rollers, a belt transport roller 504 that drives the endless belt 503, a tension roller 505 that provides a tensile force to the endless belt 503, and a press roller 506 with an elastic layer formed on its surface. A heating unit side of the heating member 501 comes into contact with the inside of the endless belt 503 to press the endless belt 503 in the direction of the press roller 506 and forms a fixing nip with a predetermined width with the press roller 506. In a configuration in which the heating member 501 heats a sheet via the endless belt 503 while forming a nip region, responsiveness at the time of energization is higher than in the case of a heating scheme by a halogen lamp.

The endless belt 503 is a film-shaped member. For example, a silicon rubber layer with a thickness of 200 μm is formed on an SUS base with a thickness of 50 μm or the outside of polyimide which is a heat-resistant resin of 70 μm. The outermost circumference of the endless belt 503 is coated with a surface protection layer such as perfluoroalkoxy alkane (PFA). In the press roller 506, for example, a silicon sponge layer with a thickness of 5 mm is formed on the surface of an iron rod with ϕ100 mm and the outer circumference is coated with a surface protection layer such as PFA.

In the heating member 501, a glaze layer and a heat generation resistant layer are stacked on a ceramic substrate. To prevent excessive heat dissipation to the opposite side and bending of a substrate, the heat generation resistant layer is formed of, for example, an existing material such as $TaSiO_2$ and is segmented into a predetermined number of pieces with a predetermined length in a main scanning direction (a longitudinal direction of the heating member 501). The individual segmented heat generation resistant layer is equivalent to a heater element H and generates heat by direct-current or alternating-current application voltage. The thermistor 502 is provided in accordance with each of the plurality of heater elements H and measures temperature corresponding to each heater element H.

A method of forming the heat generation resistant layer is similar to an existing method (for example, a method of generating a thermal head) and a masking layer is formed on the heat generation resistant layer with aluminum. The adjacent heat generation resistant layers are insulated from each other and an aluminum layer is formed in a pattern in which the heat generation resistors (the heater elements H) are exposed in a sheet transport direction. For energization of the heat generation resistant layers, wirings are connected from aluminum layers (electrodes) at both ends and each heat generation resistant layer is connected to a switching element of a switching driver IC. Further, a protective layer is formed on an uppermost portion to cover all of the heat generation resistant layer, the aluminum layer, and the wrings. The protective layer is formed of $Si_3N_4$, for example.

In the embodiment, a developer image is fixed to a sheet by heating the developer image via a film-shaped member in the fixer 50.

Referring back to FIG. 1, the sheet accommodation unit 140 accommodates sheets to be used to form images in the printer 130.

The image reading unit 200 obtains reading target image information based on brightness of light. The image reading unit 200 records the obtained image information. The recorded image information may be transmitted to another information processing device via a network. An image of the image information may be formed on a sheet by the printer 130. The image reading unit 200 may include an automatic document feeder (ADF).

Figure 3:
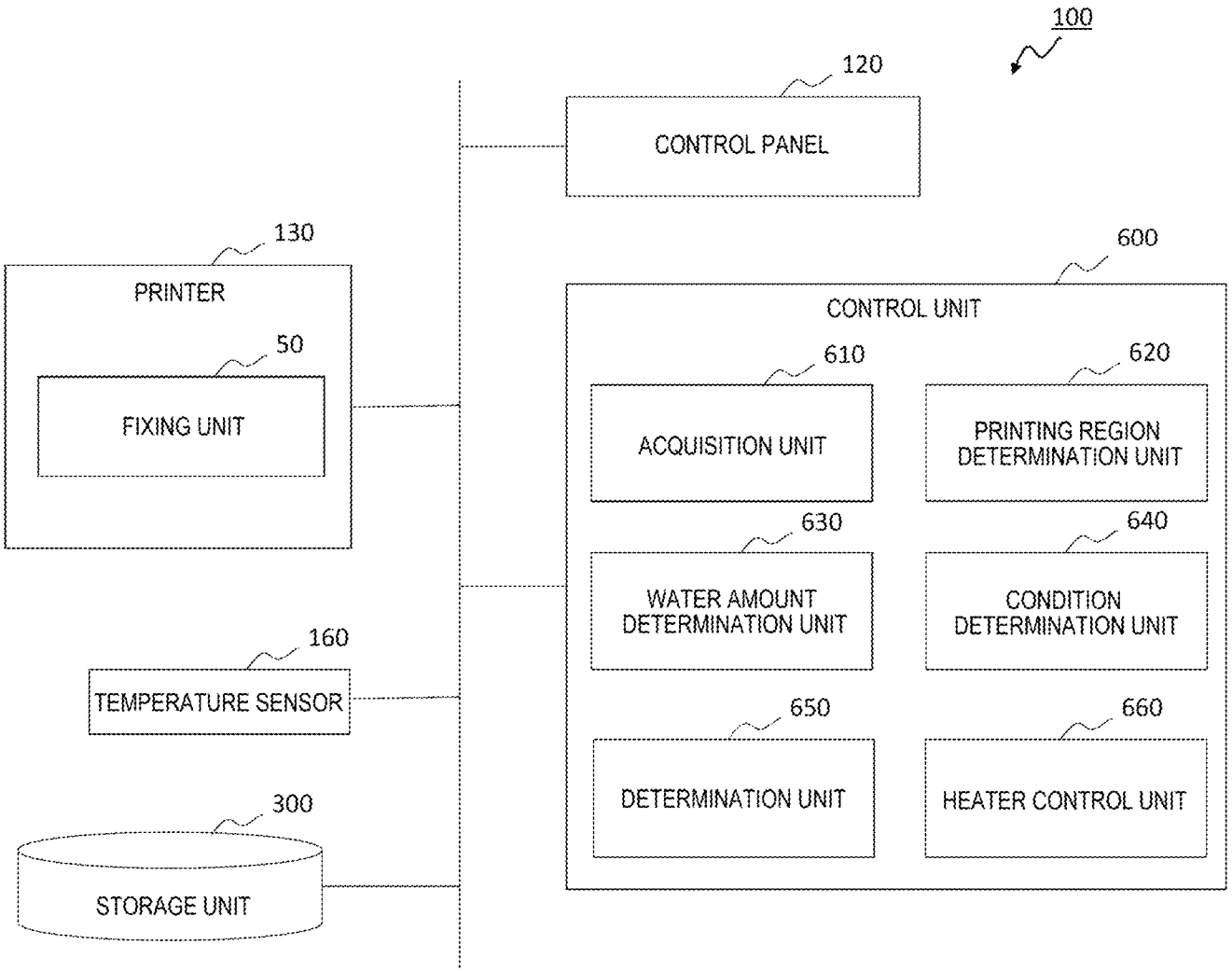
FIG. 3 is a block diagram illustrating functional units of the image forming apparatus.

FIG. 3 is a block diagram illustrating functional units of the image forming apparatus 100 according to an embodiment. The image forming apparatus 100 includes a control panel 120, a printer 130, a storage unit 300, and a control unit 600. The control panel 120 and the printer 130 described with reference to FIGS. 1 and 2 will not be described.

The storage unit 300 includes a storage device such as a magnetic hard disc device or a semiconductor storage device. The storage unit 300 stores a predetermined condition and image data to be printed. The predetermined condition is a condition related to energization and non-energization of the plurality of heater elements H. Specific description of the predetermined condition will be made with reference to the drawings subsequent to FIG. 4. The storage unit 300 stores a program for mode setting (hereinafter referred to as an "operation mode") of an operation performed by the image forming apparatus 100 in advance. The storage unit 300 may store information other than the foregoing information.

The control unit 600 is configured using a processor such as a central processing unit (CPU). When the processor executes a program, the control unit 600 functions as an acquisition unit 610, a printing region determination unit 620, a water amount determination unit 630, a condition determination unit 640, a decision unit 650, and a heater control unit 660.

The acquisition unit 610 acquires humidity around the image forming apparatus 100. The acquisition unit 610 may acquire humidity in the vicinity of the image forming apparatus 100 from a humidity sensor 160 provided in the image forming apparatus 100 as in FIG. 3 or may acquire humidity around the image forming apparatus 100 via a network.

The printing region determination unit 620 logically segments a sheet as a region. When the number of heater elements H is N (where N is an integer equal to or greater than 1), the printing region determination unit 620 logically segments the region of the sheet into N pieces in accordance with the number of heater elements H in the main scanning direction. The printing region determination unit 620 logically segments the region of the sheet in accordance with a distance in a sub-scanning direction (a sheet transport direction) or a printing time. Thus, the printing region determination unit 620 decides segmented regions on the sheet (hereinafter referred to as "sheet region") by logically segmenting the sheet in the main scanning direction and the sub-scanning direction.

For example, when the image forming apparatus 100 or the fixer includes 8 heater elements H, the printing region determination unit 620 decides the 8 segmented sheet regions in the main scanning direction. For example, the printing region determination unit 620 decides the 8 segmented sheet regions in the sub-scanning direction in accordance with the distance of the sheet in the sub-scanning direction or a printing time. The printing region determination unit 620 logically segments the sheet into 8 pieces in the main scanning direction and the sub-scanning direction and decides 64 sheet regions on the sheet.

Subsequently, the printing region determination unit 620 determines whether or not toner is formed for each of the segmented sheet regions. The printing region determination unit 620 determines whether an image is formed in a certain sheet region based on input image data and each sheet region. Thus, the printing region determination unit 620 can determine whether or not the toner is formed. When the toner is determined to be formed in a sheet region, the printing region determination unit 620 determines the sheet region as an image-forming region, and therefore a heating region to be heated. When no toner is determined to be formed in a sheet region, the printing region determination unit 620 determines the sheet region as a non-image-forming region. The printing region determination unit 620 transmits a determination result to the condition determination unit 640 and the heater control unit 660.

The printing region determination unit 620 determines whether or not a sheet has passed. The printing region determination unit 620 determines whether or not all of the segmented sheet regions have passed through the heating member 501. When it is determined that all the sheet regions have passed through the heating member 501, the printing region determination unit 620 determines that the sheet has passed. When it is determined that all the sheet regions have not passed through the heating member 501, the printing region determination unit 620 determines that the sheet has not passed.

The water amount determination unit 630 determines a water amount in the sheet based on the humidity around the image forming apparatus 100 acquired by the acquisition unit 610. The water amount determination unit 630 determines whether or not the humidity is greater than a predetermined threshold. For example, the water amount determination unit 630 determines 30% and 60% as the predetermined threshold. When the humidity acquired by the acquisition unit 610 is equal to or less than 30% or less, the water amount determination unit 630 determines that the water amount in the sheet is "small." When the humidity acquired by the acquisition unit 610 is greater than 30% and equal to or less than 60%, the water amount determination unit 630 determines that the water amount in the sheet is "normal." When the humidity acquired by the acquisition unit 610 is greater than 60%, the water amount determination unit 630 determines that the water amount in the sheet is "large."

In the embodiment, the above specific thresholds of the humidity are merely an example, and the number of thresholds and their values may be arbitrarily determined. The water amount determination unit 630 may determine the water amount in the sheet by reading water amount information indicating the water amount in the sheet associated with the humidity from the storage unit 300 storing the water amount information in advance.

Subsequently, the water amount determination unit 630 determines a threshold number of allowable continuous non-heating regions based on the determined water amount in the sheet. The threshold number of allowable continuous non-heating regions is the number of non-heating regions that are allowed to continue in the sheet regions in the sub-scanning direction. The water amount determination unit 630 determines the threshold number threshold of allowable continuous non-heating regions to "X (where X is an integer equal to or greater than 1). For example, when the water amount in the sheet is "normal", the threshold number of allowable continuous non-heating regions is determined to "3". For example, when the water amount in the sheet is "small", the threshold number of allowable continuous non-heating regions is determined to "4." For example, when the water amount in the sheet is "large", the threshold number of continuous non-heating regions is determined to "2." The threshold number of allowable non-heating regions may be voluntarily determined as well as the above-described values.

The condition determination unit 640 determines which one of the plurality of heater elements H is to be energized based on the predetermined condition. The predetermined condition is a condition for determining whether or not to heat the heater element H on the basis of the positions of the image-forming regions, the positions of the non-image-forming regions, and the water amount in the sheet based on the humidity is to be energized (heated). The condition determination unit 640 determines which one of the plurality of heater elements H is to be energized based on a positional relation between the image-forming regions and the non-image-forming regions. The condition determination unit 640 determines which one of the plurality of heater elements H is to be energized also based on the threshold number of allowable continuous non-heating regions determined by the water amount determination unit 630. A determination method of the condition determination unit 640 will be described specifically below.

Main Scanning Direction

The condition determination unit 640 determines whether or not there are the continuous non-image-forming regions in the main scanning direction based on the positional relation between the image-forming regions and the non-image-forming regions. The condition determination unit 640 determines whether or not a non-image-forming region exists between and adjacent to the image-forming regions in the main scanning direction based on the positional relation between the image-forming regions and the non-image-forming regions.

Sub-Scanning Direction

The condition determination unit 640 determines whether or not the number of continuous non-image-forming regions is greater than the threshold number of allowable continuous non-heating regions determined by the water amount determination unit 630. For example, when the sheet region adjacent to a non-image-forming region is a non-image-forming region in the sub-scanning direction, the condition determination unit 640 counts the sheet regions as the continuous non-image-forming regions. The condition determination unit 640 determines whether or not the number of continuous non-image-forming regions in the sub-scanning direction is greater than the threshold.

The decision unit 650 decides one or more heater elements H to be energized based on a determination result of the condition determination unit 640. A decision method of the decision unit 650 is different between the main scanning direction and the sub-scanning direction. Therefore, each decision method in the main scanning direction and the sub-scanning direction will be described below.

Main Scanning Direction

The decision unit 650 decides one or more heater elements H to be energized based on a determination result of the condition determination unit 640 in the main scanning direction. When it is determined that a non-image-forming region exists between and adjacent to two image-forming regions, the decision unit 650 decides the non-image-forming region as an extension heating region. The extension heating region is a region in which it is necessary to cause the heater element H to be energized (heating) although no toner is formed. By deciding the extension heating region, it is possible to prevent or reduce occurrence of wrinkles in the main scanning direction. When it is determined that a sheet region adjacent to a non-image-forming region is another non-image-forming region, the decision unit 650 does not decide both of the non-image-forming regions as the extension heating regions.

Sub-Scanning Direction

The decision unit 650 decides one or more heater elements H to be energized based on the determination result of the condition determination unit 640 in the sub-scanning direction. When the number of continuous non-image-forming regions is greater than the threshold, the decision unit 650 decides a non-image-forming region subsequent to the continuous non-image-forming region of the threshold number as an extension heating region. When the number of continuous non-image-forming regions is not greater than the predetermined threshold, the decision unit 650 does not decide any of the non-image-forming regions as the extension heating region.

The heater control unit 660 controls the one or more heater elements H based on the determination result of the printing region determination unit 620 and the decision result of the decision unit 650. The heater control unit 660 causes one or more heater elements H corresponding to the heating regions determined by the printing region determination unit 620 and the extension heating region decided by the decision unit 650 to be energized (heating).

Figure 4:
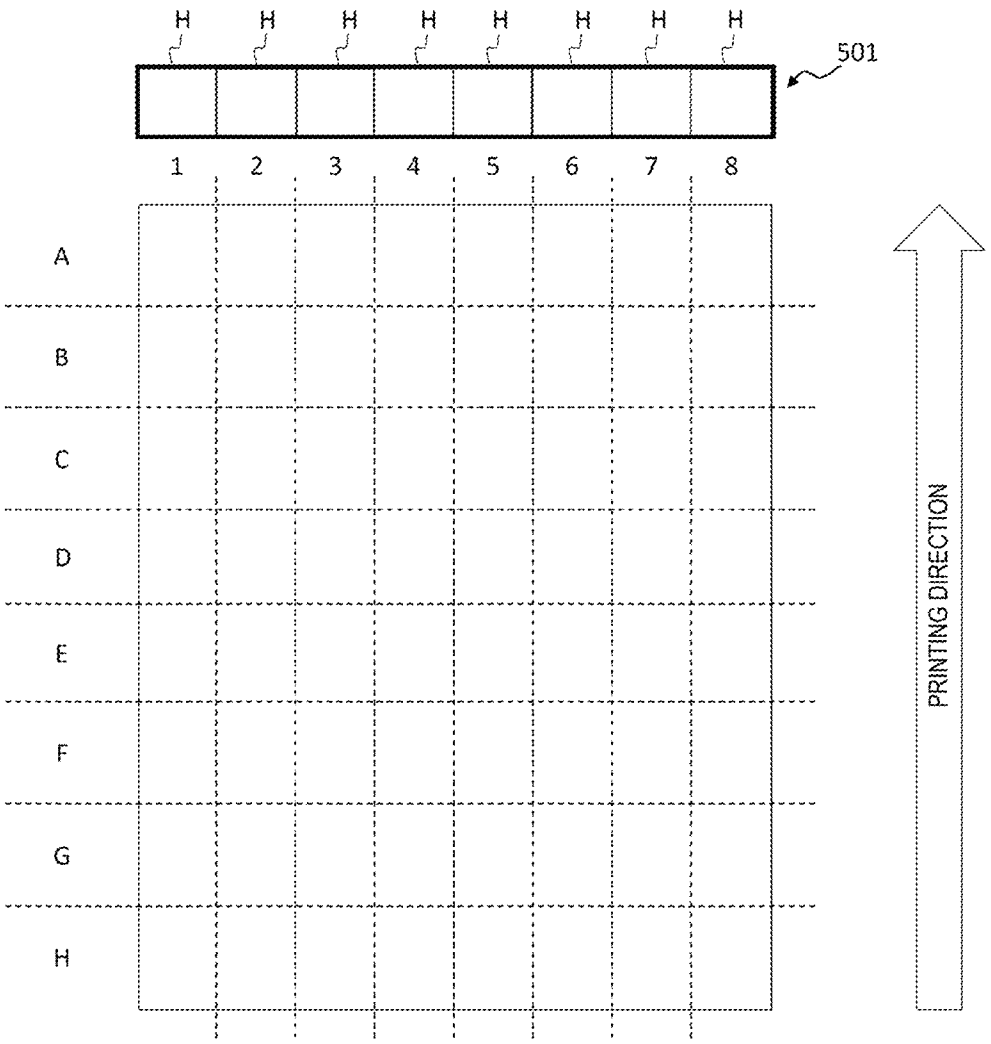
FIG. 4 is a diagram illustrating a specific example of a sheet region.

FIG. 4 is a diagram illustrating a specific example of a sheet region according to an embodiment.

In the following example, when a sheet region is indicated, the main scanning direction is written with a number and the sub-scanning direction is written with an alphabetical character. That is, a sheet region A-1 is a sheet region which is "a first region in the sub-scanning direction" and "a first region in the main scanning direction."

In the example of FIG. 4, since there are 8 heater elements H in the heating member 501, the printing region determination unit 620 decides the 8 segmented sheet regions in the main scanning direction. In FIG. 4, for example, the printing region determination unit 620 determines the 8 segmented sheet regions of A to H in the sub-scanning direction. The printing region determination unit 620 decides 64 sheet regions on the sheet by segmenting the sheet into 8 pieces in each of the main scanning direction and the sub-scanning direction.

Figure 5:
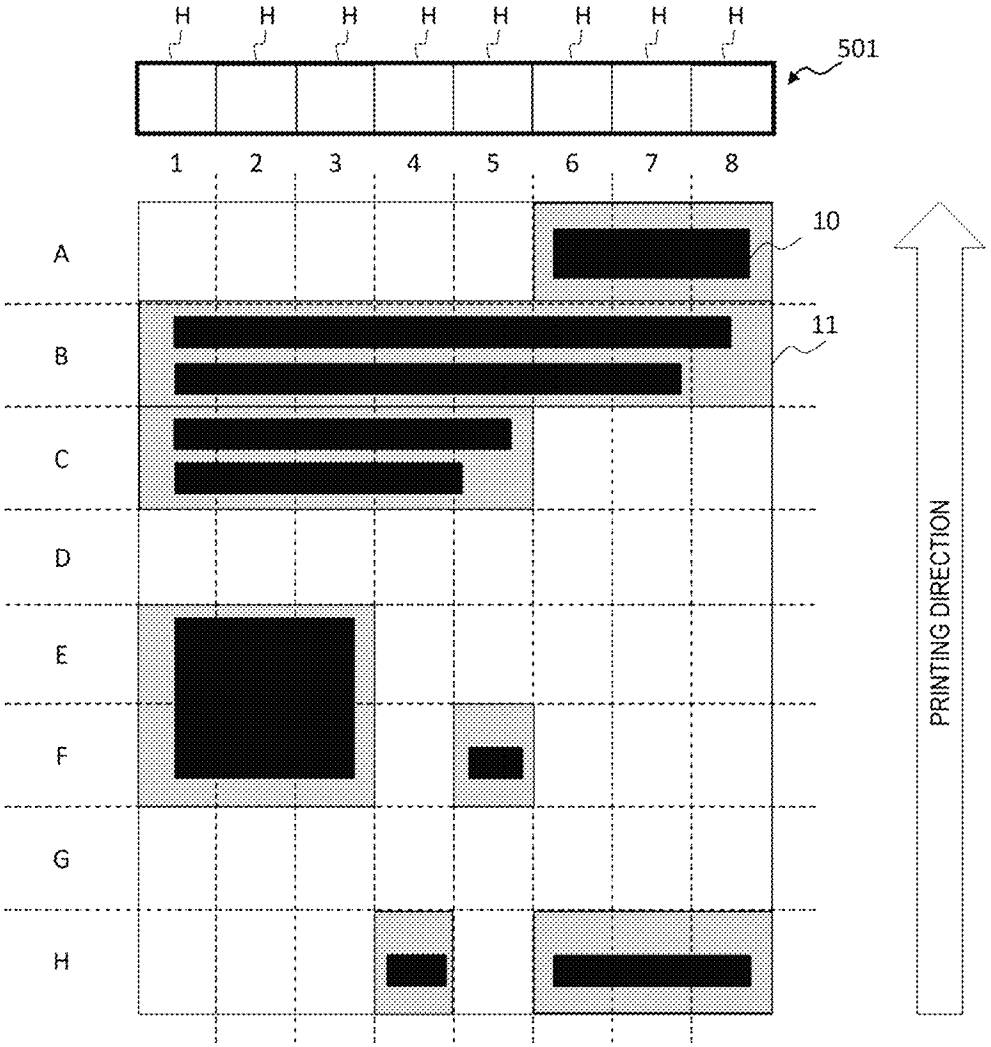
FIG. 5 is a diagram illustrating a specific example of a printing region and a heating region.

FIG. 5 is a diagram illustrating a specific example of a printing region and a heating region according to an embodiment.

FIG. 5 is diagram exemplifying a sheet region, toner 10 of a printed image transferred to a sheet, the heater elements H to which the sheet is transported, and a heating region 11. In FIG. 5, the description of the content described in FIG. 4 will not be repeated.

In the example of FIG. 5, the printing region determination unit 620 determines whether or not the toner 10 is formed. The printing region determination unit 620 determines regions in which the toner 10 is formed as A-6 to 8, B-1 to 8, C-1 to 5, E-1 to 3, F-1 to 3, F-5, H-4, and H-6 to 8 and decides the regions as the heating regions 11.

Figure 6:
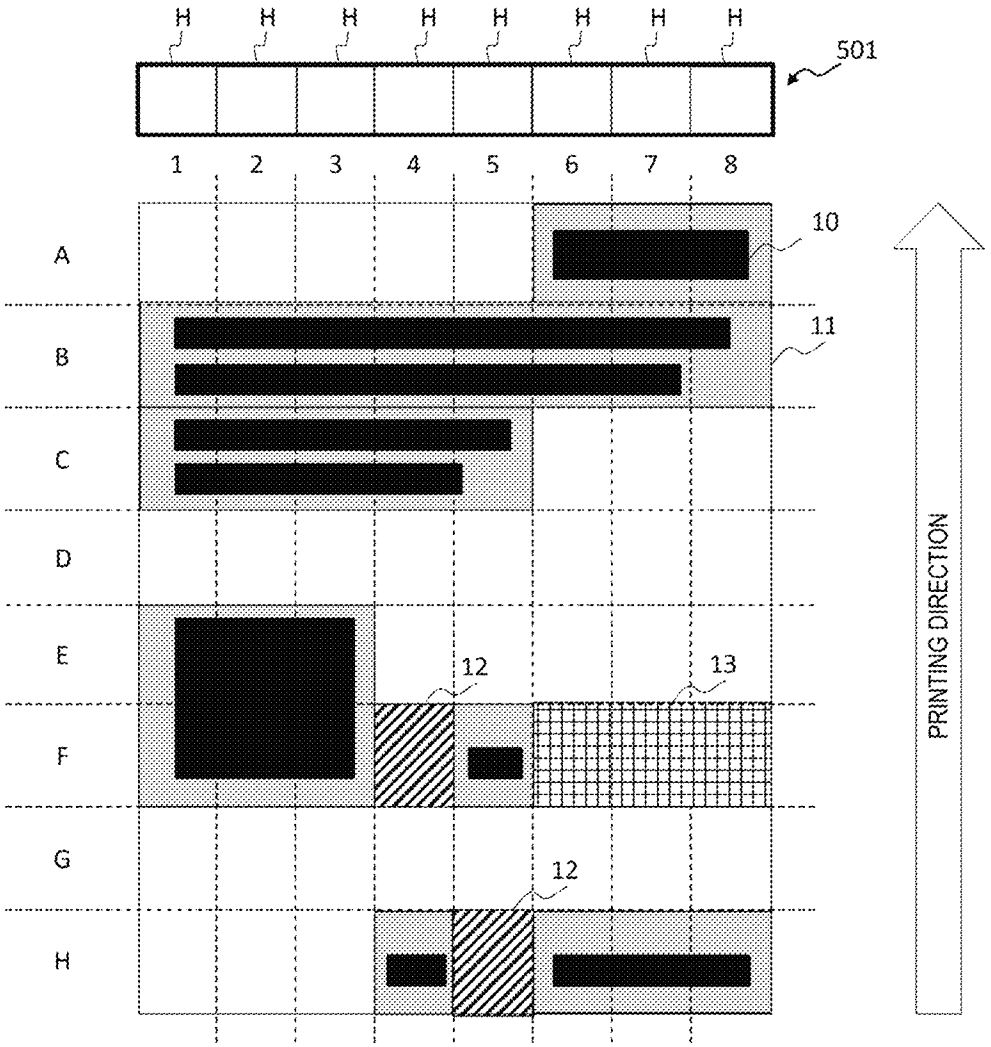
FIG. 6 is a diagram illustrating a specific example of a printing region, a heating region, and an extension heating region.

FIG. 6 is a diagram illustrating a specific example of a printing region, a heating region, and an extension heating region according to the embodiment.

FIG. 6 is a diagram exemplifying sheet regions, the toner 10 of a printed image transferred to a sheet, the heater elements H to which the sheet is transported, the heating regions 11, and extension heating regions 12 and 13. In FIG. 6, the description of the content described in FIGS. 4 and 5 will be committed. In FIG. 6, a case in which the threshold number of allowable continuous non-heating regions decided by the water amount determination unit 630 is "3" (when the water amount in the sheet is "normal") will be described.

The decision unit 650 decides the extension heating regions 12 based on a determination result in the main scanning direction by the condition determination unit 640. In FIG. 6, the extension heating regions 12 are F-4 and H-5. In the main scanning direction, F-4 and H-5 are sheet regions between the heating regions. Therefore, F-4 and H-5 are determined as the extension heating regions and are heated. The decision unit 650 decides the extension heating region 13 based on a determination result in the sub-scanning direction by the condition determination unit 640. In FIG. 6, the extension heating regions 13 are F-6 to 8. In the sub-scanning direction, F-6 to 8 are sheet regions greater than the threshold. Therefore, F-6 to 8 are the non-image-forming regions, but are determined to be the extension heating regions 13 and are heated.

Figure 7:
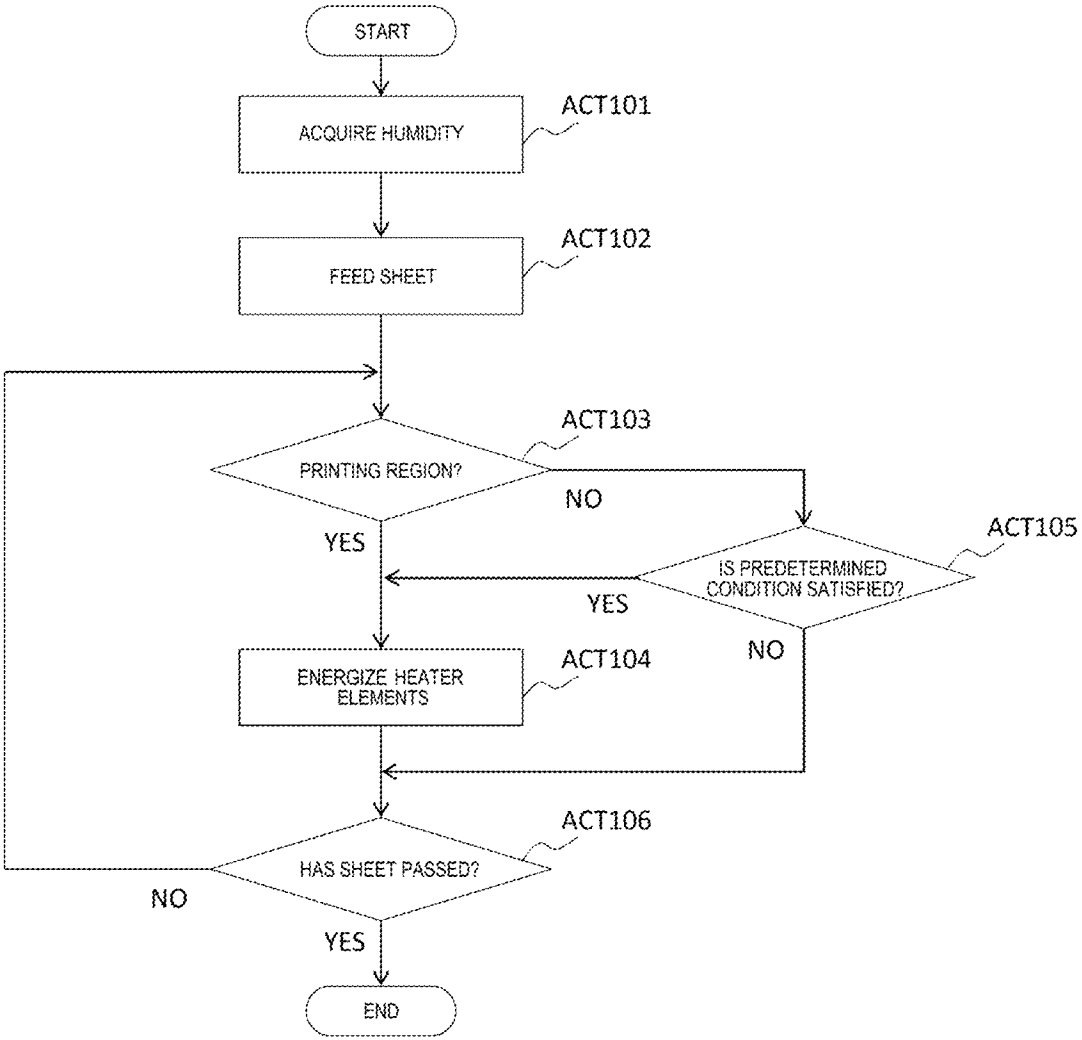
FIG. 7 is a flowchart illustrating a flow of printing carried out by the image forming apparatus.

FIG. 7 is a flowchart illustrating a flow of printing of the image forming apparatus 100 according to an embodiment. Since the predetermined condition has been described above, the description thereof will not be repeated.

The acquisition unit 610 acquires the humidity around the image forming apparatus 100 (ACT 101). The image forming apparatus 100 starts feeding a sheet from the sheet accommodation unit 140 to perform printing (ACT 102).

The printing region determination unit 620 determines a region in which an image is formed in the sheet region (ACT 103). When toner is formed in the sheet region (YES in ACT 103), the printing region determination unit 620 sends the sheet region as an image-forming region, therefore, a heating region to the heater control unit 660. The heater control unit 660 causes one or more of the heater elements H which correspond to the heating regions and the extension heating regions based on the heating regions and the extension heating regions to be energized (heating) (ACT 104).

When no toner is formed in the sheet region (NO in ACT 103), the printing region determination unit 620 sends the sheet region as a non-image-forming region to the condition determination unit 640. The condition determination unit 640 determines which one or more of the plurality of heater elements H are to be energized (heating) based on a predetermined condition (ACT 105). The predetermined condition is a condition for determining whether the heater elements H determined on the basis of the positions of the heating regions, the positions of the non-heating regions, and the water amount based on the humidity is to be energized (heating).

When the predetermined condition is satisfied (YES in ACT 105), the decision unit 650 decides the extension heating regions and causes the process to proceed to ACT 104. The predetermined condition is satisfied in a case in which a non-image-forming region exists between and adjacent to two image-forming regions in the main scanning direction, and a case in which the number of continuous non-image-forming regions in the sub-scanning direction is greater than the threshold.

When the predetermined condition is not satisfied (NO in ACT 105), the printing region determination unit 620 determines whether or not the sheet has passed (ACT 106). The predetermined condition is not satisfied in a case in which a non-image-forming region is not between and adjacent to two image-forming regions in the main scanning direction, and a case in which the number of continuous non-image-forming regions in the sub-scanning direction is not greater than the threshold.

When all the sheet regions have not passed through the heating member 501 of the fixer (NO in ACT 106), the printing region determination unit 620 determines that the sheet has not passed and causes the process to proceed to ACT 103. When all the sheet regions have passed through the heating member 501 (YES in ACT 106), the printing region determination unit 620 determines that the sheet has passed and ends the process.

The image forming apparatus 100 with the foregoing configuration includes the decision unit 650 and the heater control unit 660. A non-image-forming region satisfying the predetermined condition is decided as the extension heating region and the heater elements H corresponding to the heating region and the extension heating region can be to be energized (heating). Thus, it is possible to prevent or reduce wrinkles of the sheet due to a water evaporation amount of the sheet.

Modification Examples

Figure 8:
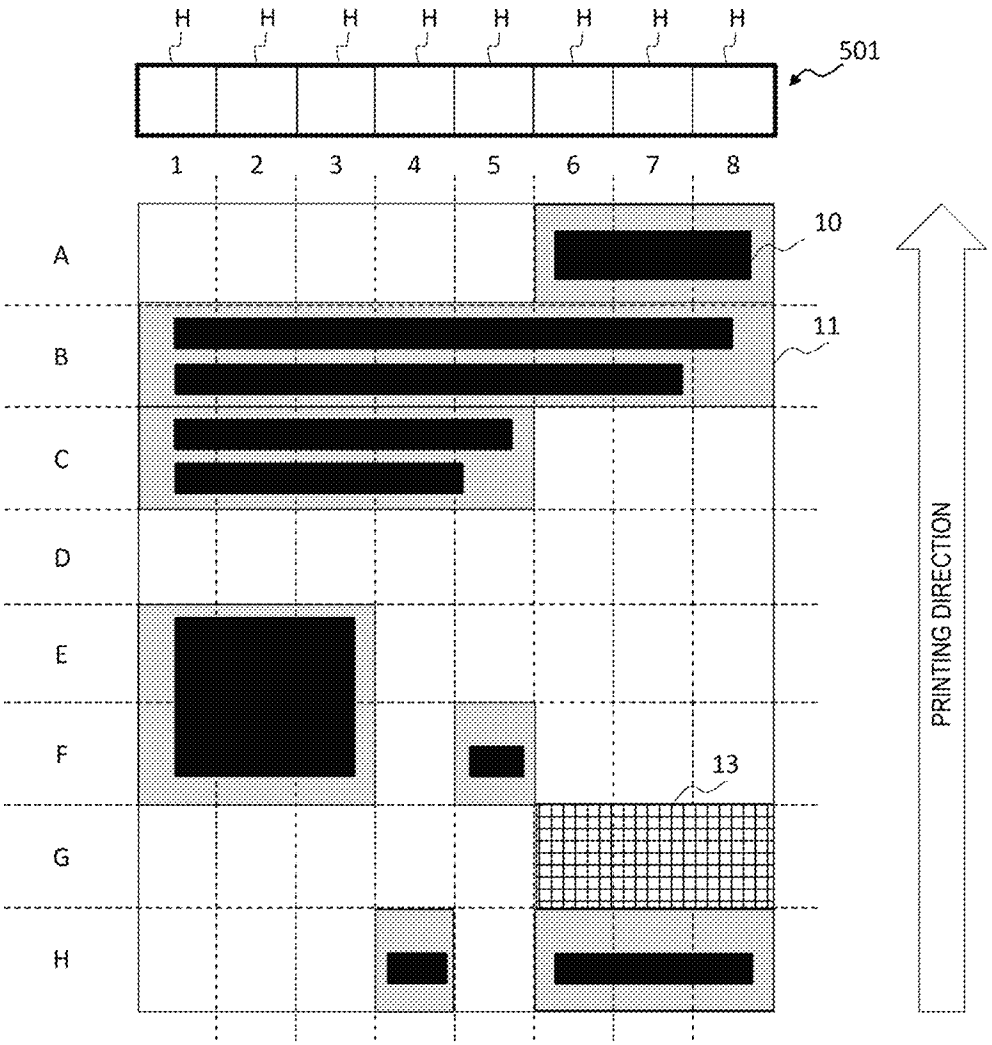
FIG. 8 is a diagram illustrating a specific example of a printing region, a heating region, and an extension heating region according to a modification example.

FIG. 8 is a diagram illustrating a specific example of a printing region, a heating region, and an extension heating region according to a modification example.

FIG. 8 is a diagram exemplifying sheet regions, the toner 10 of a printed image transferred to the sheet, the heater elements H to which the sheet is transported, the heating region 11, and the extension heating region 13. In FIG. 8, the description of the content described in FIGS. 4 to 6 will not be repeated.

In FIG. 8, the threshold number of allowable continuous non-heating regions decided by the water amount determination unit 630 is assumed to be "4" (when the water amount in the sheet is "small"). The decision unit 650 decides the extension heating region 12 based on a determination result in the main scanning direction by the condition determination unit 640. However, in FIG. 8, since the water amount in the sheet is "small", the extension heating region 12 is not considered. The decision unit 650 decides the extension heating region 13 based on the determination result of the threshold "4" in the sub-scanning direction by the condition determination unit 640. In FIG. 8, the extension heating regions 13 are G-6 to 8.

Figure 9:
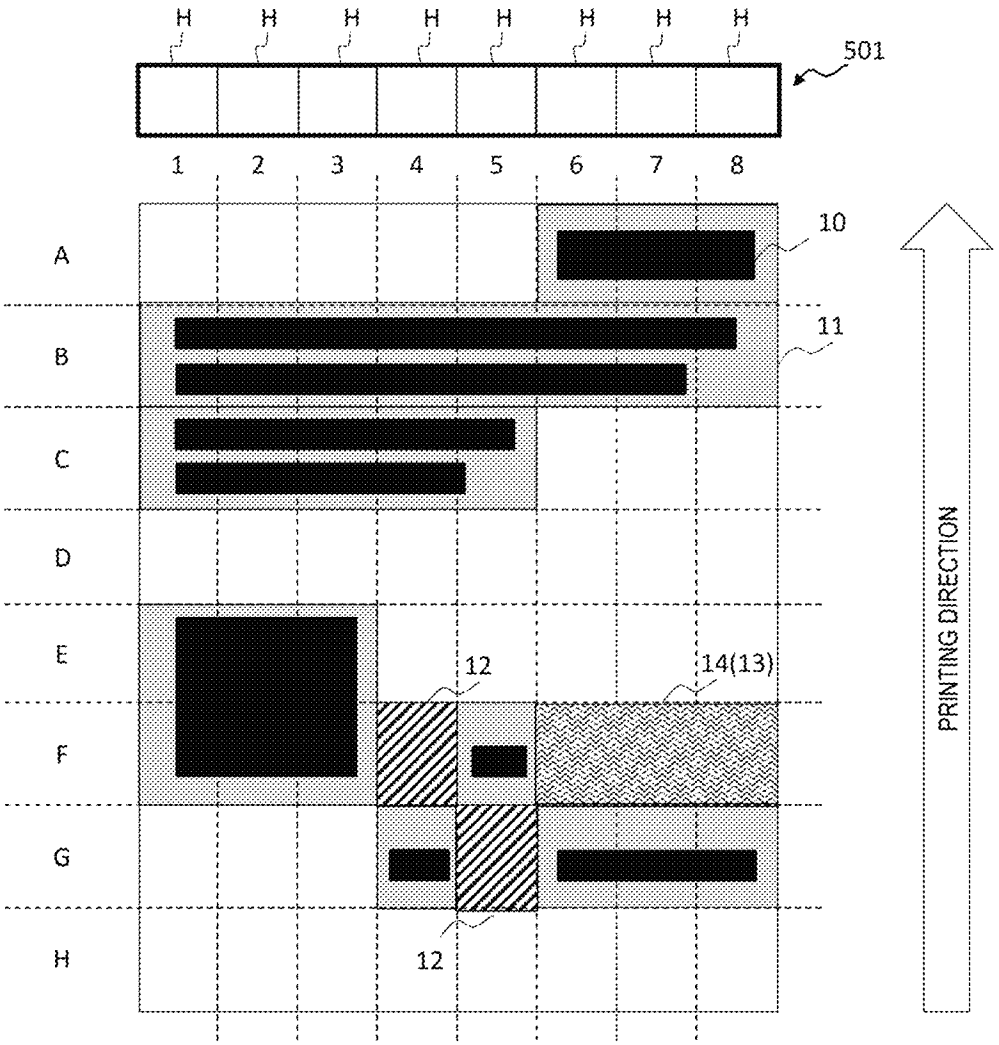
FIG. 9 is a diagram illustrating a specific example of a printing region, a heating region, an extension heating region, a cancellation region, and a non-heating region according to a modification example.

FIG. 9 is a diagram illustrating a specific example of a printing region, a heating region, an extension heating region, a cancellation region, and a non-heating region according to a modification example.

FIG. 9 is a diagram exemplifying sheet regions, the toner 10 of a printed image transferred to the sheet, the heater elements H to which the sheet is transported, the heating region 11, an extension heating region 12, and a cancellation region 14. The cancellation region 14 is a region in which heating is not performed when a sheet region satisfies the condition to be eligible as an extension heating region 13 in the sub-scanning direction, but a subsequent region of the sheet region is a heating region in the sub-scanning direction. Then, the heater control unit 660 does not cause the heater element H corresponding to the region determined to be the cancellation region to be energized (heating).

In FIG. 9, F-6 to 8 are first determined to be eligible as extension heating regions 13 based on the threshold "3" in the sub-scanning direction. However, since the subsequent regions (G-6 to 8) of F-6 to 8 are heating regions, the decision unit 650 decides F-6 to 8 as cancellation regions and does not energize (heating). In FIG. 9, the description of the content described in FIGS. 4 to 6 and 8 will not be repeated.

Figure 10:
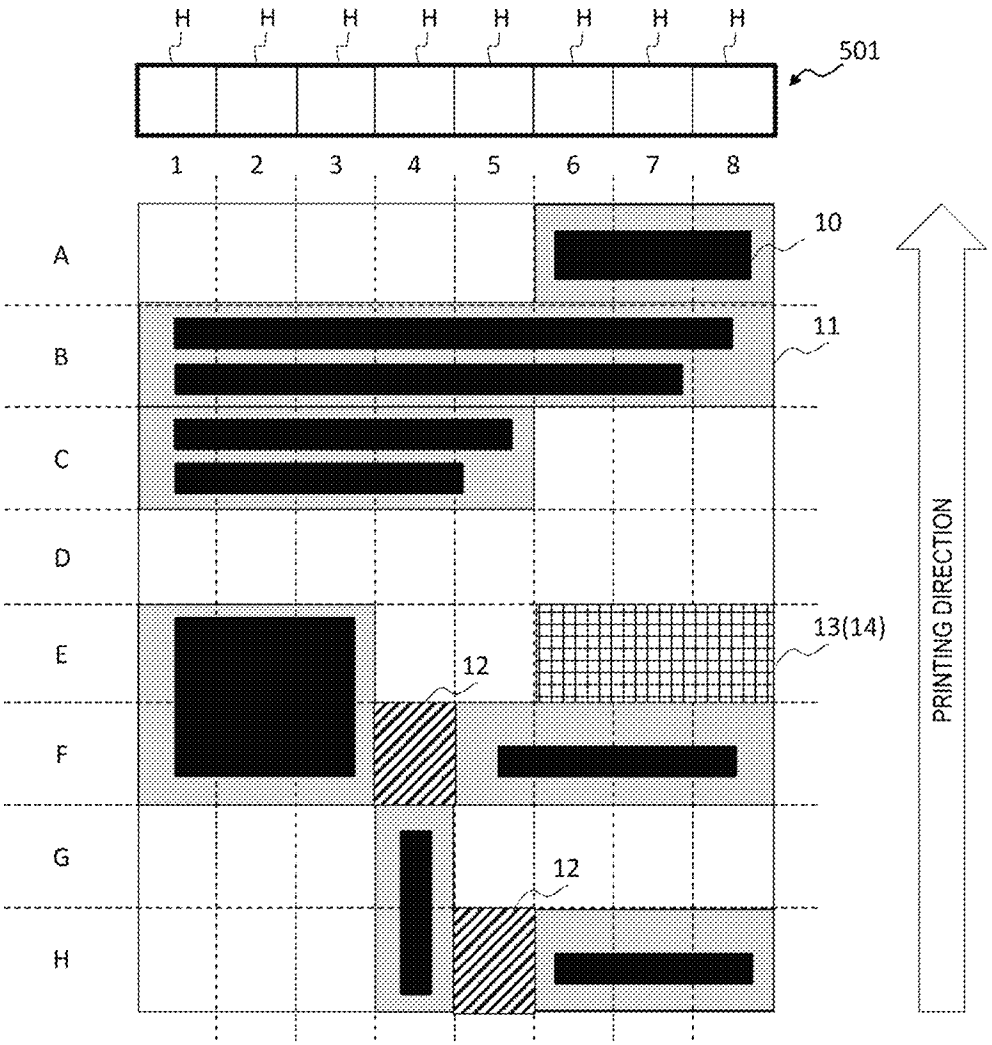
FIG. 10 is a diagram illustrating a specific example of a printing region, a heating region, an extension heating region, a cancellation region, and a non-heating region according to a modification example.

In FIG. 10, the threshold number of allowable continuous non-heating regions decided by the water amount determination unit 630 is assumed to be "2" (when the water amount in the sheet is "large"). The decision unit 650 decides one or more extension heating region 12 based on a determination result in the main scanning direction by the condition determination unit 640. In FIG. 9, extension heating regions 12 are F-4 and H-5.

The decision unit 650 decides one or more extension heating regions 13 based on the determination result in the sub-scanning direction of the condition determination unit 640. Originally, in FIG. 10, since the subsequent regions F-6 to 8 of the extension heating region 13 are the heating region, E-6 to 8 would have been determined to be the cancellation regions if assuming the water amount in the sheet were "normal" as in FIG. 9. However, when the water amount in the sheet is "large", wrinkles of the sheet are more likely to occur. Therefore, the decision unit 650 decides E-6 to 8 as the extension heating region 13, not the cancellation region.

When a region in the main scanning direction is segmented, the printing region determination unit 620 may segment the region equally in accordance with the number of heater elements H or may segment the region as one region together with the plurality of heater elements H. The printing region determination unit 620 may segment the region in the main scanning direction based on the distance of the sheet. In this case, the printing region determination unit 620 may decide the heater elements H corresponding to the segmented regions.

When a region in the sub-scanning direction is segmented, the printing region determination unit 620 may segment the region equally in accordance with the distance of the sheet or may segment the region in accordance with any distance. When a region in the sub-scanning direction is segmented, the printing region determination unit 620 may segment the region in accordance with a time period during which the corresponding region of the sheet passes.

When a subsequent region of a non-printing region is a non-printing region in the main scanning direction, the condition determination unit 640 may determine whether or not the number of continuous non-printing regions exceeds a threshold.

The condition determination unit 640 may determine whether or not a time period of non-energization (non-heating) of the heater element H is greater than a predetermined threshold in the sub-scanning direction. When the time period of the non-energization (non-heating) of the heater element H is greater than the predetermined threshold, the decision unit 650 may decide a region corresponding to the heater element H which is not energized (heating) as an extension heating region.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

a heater including a plurality of heater elements arranged in a main scanning direction to fix an image on a sheet passing a nip; and a controller configured to:

determine image-forming regions and non-image-forming regions among sheet regions of the sheet divided in the main scanning direction based on image data of the image;

determine, as heating regions, the image-forming regions and a first part of the non-image-forming regions satisfying a predetermined condition;

determine, as non-heating regions, a second part of the non-image-forming regions not satisfying the predetermined condition; and energize one or more of the heater elements corresponding to the heating regions, selectively at timing when the heating regions pass the nip.

2. The image forming apparatus according to claim 1, wherein the predetermined condition is associated with a humidity around the image forming apparatus.

3. The image forming apparatus according to claim 2, wherein the controller is further configured to obtain the humidity around the image forming apparatus from a humidifier connected thereto, and determine whether or not the predetermined condition, which is associated with the humidity, is satisfied based on the obtained humidity.

4. The image forming apparatus according to claim 1, wherein the predetermined condition is satisfied when a first condition associated with a positional relationship of one or more image forming regions and one or more non-image-forming regions aligned in the main scanning direction is met.

5. The image forming apparatus according to claim 4, wherein the first condition is met when a non-image-forming region is positioned between and adjacent to two image-forming regions in the main scanning direction.

6. The image forming apparatus according to claim 1, wherein the number of sheet regions divided in the main scanning direction is equal to the number of heater elements.

7. An image forming method using an image forming apparatus including a heater including a plurality of heater elements arranged in a main scanning direction to fix an image on a sheet passing a nip, the method comprising:

determining image-forming regions and non-image-forming regions among sheet regions of the sheet divided in the main scanning direction based on image data of the image;

determining, as heating regions, the image-forming regions and a first part of the non-image-forming regions satisfying a predetermined condition;

determining, as non-heating regions, a second part of the non-image-forming regions not satisfying the predetermined condition; and energizing one or more of the heater elements corresponding to the heating regions, selectively at timing when the heating regions pass the nip.

8. The image forming method according to claim 7, wherein the predetermined condition is associated with a humidity around the image forming apparatus.

9. The image forming method according to claim 8, further comprising:

obtaining the humidity around the image forming apparatus from a humidifier; and determining whether or not the predetermined condition, which is associated with the humidity, is satisfied based on the obtained humidity.

10. The image forming method according to claim 7, wherein the predetermined condition is satisfied when a first condition associated with a positional relationship of one or more image forming regions and one or more non-image-forming regions aligned in the main scanning direction is met.

11. The image forming method according to claim 10, wherein the first condition is met when a non-image-forming region is positioned between and adjacent to two image-forming regions in the main scanning direction.

12. The image forming method according to claim 7, wherein the number of sheet regions divided in the main scanning direction is equal to the number of heater elements.

13. An image forming apparatus, comprising:

a heater configured to fix an image on a sheet passing a nip; and a controller configured to:

determine image-forming regions and non-image-forming regions among sheet regions of the sheet divided in a sub scanning direction based on image data of the image;

determine, as heating regions, the image-forming regions and a first part of the non-image-forming regions satisfying a predetermined condition;

determine, as non-heating regions, a second part of the non-image-forming regions not satisfying the predetermined condition; and energize the heater selectively at timing when the heating regions pass the nip.

14. The image forming apparatus according to claim 13, wherein the predetermined condition is satisfied when a first condition associated with a positional relationship of one or more image forming regions and one or more non-image-forming regions aligned in the sub-scanning direction is met.

15. The image forming apparatus according to claim 14, wherein the first condition is met when the number of continuous non-image-forming regions in the sub-scanning direction is greater than a threshold.

16. The image forming apparatus according to claim 15, wherein the controller is further configured to determine a water amount in the sheet based on a humidity around the image forming apparatus, wherein the threshold is a first value when the water amount in the sheet is a first amount and a second value different from the first value when the water amount in the sheet is a second amount different from the first amount.

17. The image forming apparatus according to claim 16, wherein the second value is larger than the first value, and the second amount is smaller than the first amount.

* * * * *